US010087043B2

(12) United States Patent
Ellis

(10) Patent No.: US 10,087,043 B2
(45) Date of Patent: Oct. 2, 2018

(54) MOVING MEDIA IN REVERSE DUPLEX DIRECTION ALONG MEDIA DUPLEX PATH

(71) Applicant: Hewlett-Packard Development Company, L.P., Houston, TX (US)

(72) Inventor: Daniel S. Ellis, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/510,637

(22) PCT Filed: Sep. 10, 2014

(86) PCT No.: PCT/US2014/055007
§ 371 (c)(1),
(2) Date: Mar. 10, 2017

(87) PCT Pub. No.: WO2016/039743
PCT Pub. Date: Mar. 17, 2016

(65) Prior Publication Data
US 2017/0190542 A1 Jul. 6, 2017

(51) Int. Cl.
*B65H 85/00* (2006.01)
*G03G 15/23* (2006.01)
(Continued)

(52) U.S. Cl.
CPC ..... *B65H 85/00* (2013.01); *G03G 15/2028* (2013.01); *G03G 15/234* (2013.01);
(Continued)

(58) Field of Classification Search
CPC .. B65H 29/62; B65H 85/00; B65H 2301/333; B65H 2601/255; B65H 2601/11;
(Continued)

(56) References Cited

U.S. PATENT DOCUMENTS

| | | | |
|---|---|---|---|
| 5,974,290 | A | 10/1999 | Inoue |
| 5,984,305 | A | 11/1999 | Inoue |
| 6,621,997 | B2 | 9/2003 | Chung |
| 6,694,116 | B2 | 2/2004 | Inoue et al. |
| 6,757,501 | B2 | 6/2004 | Mochizuki et al. |
| 7,871,075 | B2 | 1/2011 | Asaba |

(Continued)

FOREIGN PATENT DOCUMENTS

| | | |
|---|---|---|
| EP | 0872778 | 10/1998 |
| JP | 02277670 | 11/1990 |

(Continued)

OTHER PUBLICATIONS

International Searching Authority. ISA/KR. International Search Report. Date of mailing May 8, 2015. Application No. PCT/US2014/055007. Filing date Sep. 10, 2014.

*Primary Examiner* — Michael C McCullough
(74) *Attorney, Agent, or Firm* — HP Inc. Patent Department

(57) ABSTRACT

A method includes guiding the media n a forward simplex direction by a simplex media path of a media transport assembly of the printing apparatus to position a respective side of the media across from a toner applicator to receive toner thereon and a fuser to fuse the toner thereon. The method also includes guiding the media in a forward duplex direction to the simplex media path by the duplex media path of the media transport assembly so that another side of the media is positioned towards the toner applicator to receive the toner thereon. The method also includes selectively moving the media in a reverse duplex direction opposite from the forward duplex direction to direct the media along the duplex media path to an output area outside of the media transport assembly by the control module in response to a media flushing event.

15 Claims, 5 Drawing Sheets

(51) Int. Cl.
*G03G 15/20* (2006.01)
*G03G 15/00* (2006.01)

(52) U.S. Cl.
CPC ..... *G03G 15/6529* (2013.01); *B65H 2301/33312* (2013.01); *B65H 2511/417* (2013.01); *B65H 2511/52* (2013.01); *B65H 2511/528* (2013.01); *B65H 2513/412* (2013.01); *B65H 2513/42* (2013.01); *B65H 2601/11* (2013.01); *B65H 2801/03* (2013.01)

(58) Field of Classification Search
CPC ..... G03G 15/237; G03G 15/70; G03G 2215/00586; G03G 2215/00341; G03G 2215/00552
See application file for complete search history.

(56) References Cited

U.S. PATENT DOCUMENTS

| | | | | |
|---|---|---|---|---|
| 8,047,539 | B2 | 11/2011 | Fujita | |
| 8,391,730 | B2 * | 3/2013 | Kitagawa ..... | G03G 15/2064 271/902 |
| 2011/0211007 | A1 | 9/2011 | Okamoto et al. | |

FOREIGN PATENT DOCUMENTS

| | | |
|---|---|---|
| JP | H0753463 | 6/1995 |
| JP | 2003241458 | 8/2003 |
| JP | 2011123104 | 6/2011 |
| JP | 2011178494 | 9/2011 |
| JP | 2013001531 | 1/2013 |

* cited by examiner

MOVING MEDIA IN REVERSE DUPLEX DIRECTION ALONG MEDIA DUPLEX PATH

BACKGROUND

Printing apparatuses include toner applicators, fusers, and media transport assemblies. The media transport assembly includes a simplex media path and a duplex mega path. The simplex media path guides media to the toner applicator to position a respective side of the media towards the toner applicator to receive toner thereon and the fuser. The duplex media path guides the media to the simplex media path in a manner that another side of the media is positioned towards the toner applicator to receive toner thereon.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Figure 1:
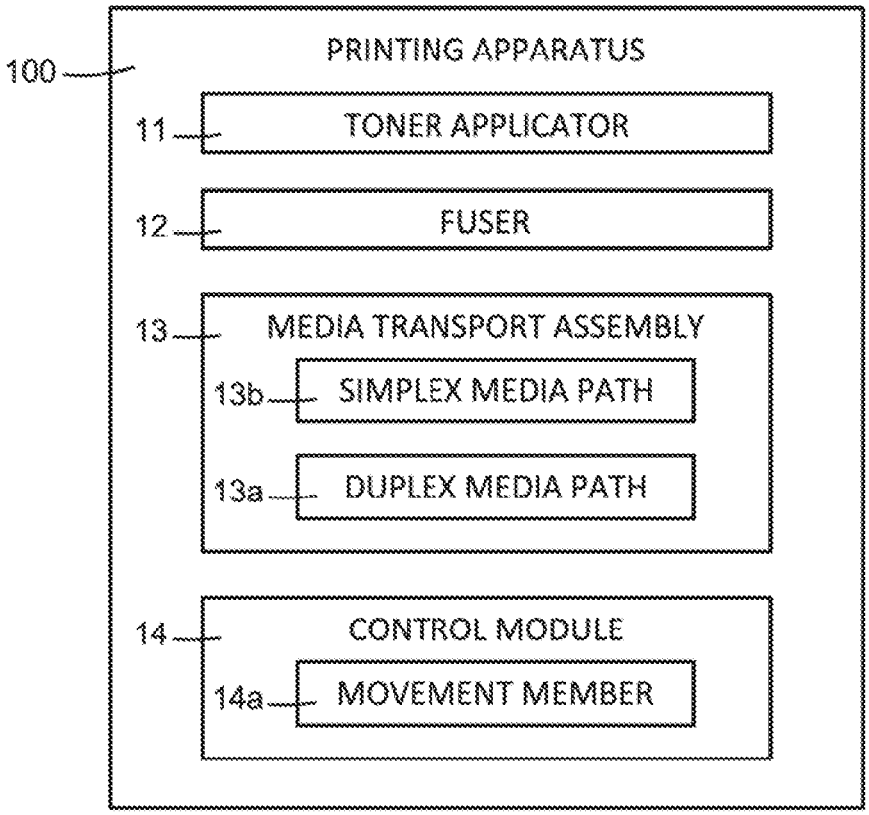
FIG. 1 is a block diagram illustrating a printing apparatus according to an example.

A printing apparatus includes a toner applicator, a fuser, and a media transport assembly. The media transport assembly includes a simplex media path and a duplex media path. The simplex media path guides media to the toner applicator to position a respective side of the media towards the toner applicator to receive toner thereon and the fuser. The duplex media path guides the media to the simplex media path in a manner that another side of the media is positioned towards the toner applicator to receive toner thereon. Media, however, may unintentionally stop in the media transport assembly due to firmware errors, losses of power, media jams, doors of printing apparatus being opened during the printing process, and the like. When media is unintentionally stopped in the media transport assembly, some of the media may be automatically advanced so that a user does not have to physically remove such media. Generally, however, automatic advancement may only be done if the media in front of other media is able to be advanced, for example, as determined by a control module including firmware having machine-readable instructions.

As such, when a media jam occurs near an output of the printing apparatus, no media can be flushed out of the media transport assembly to prevent such flushing from causing damage to the printing apparatus. Accordingly, the amount of media that may be flushed out of the media transport assembly is low. Consequently, a user may have to manually locate the jammed media and remove it resulting in a poor user experience, a poor perception of product reliability, and increased opportunities for additional errors such as unintentionally leaving portions of the media in the media transport assembly.

In examples, a method of transporting media in a printing apparatus includes guiding the media in a forward simplex direction by a simplex media path of a media transport assembly of the printing apparatus. That is, a respective side of the media is positioned across from a toner applicator to receive toner thereon and a fuser to fuse the toner thereon by the simplex media path. The method also includes guiding the media in the forward duplex direction to the simplex media path by the duplex media path of the media transport assembly. That is, another aide of the media is positioned towards the toner applicator and the fuser to receive the toner thereon.

The method also includes selectively moving the media in a reverse duplex direction opposite from the forward duplex direction to direct the media along the duplex media path to an output area outside of the media transport assembly by the control module in response to a media flushing event. That is, using the reverse duplex direction of the duplex media path in response to the media flushing event increases the amount of media that may be flushed from the media transport assembly without user intervention. Accordingly, a good user experience, a good perception of product reliability, and reduced opportunities for additional errors such as unintentionally leaving portions of the media in the media transport assembly may be attained.

FIG. 1 is a block diagram illustrating a printing apparatus according to an example. Referring to FIG. 1, in some examples, a printing apparatus 100 includes a toner applicator 11, a fuser 12, a media transport assembly 13, and a control module 14. The toner applicator 11 applies toner to media. In some examples, the toner applicator 11 may include an intermediate transport member such as an intermediate blanket to transport toner therefrom to the media. Alternatively, the toner applicator 11 may include an optical photoconductive drum, binary ink developers, toner cartridges, or the like, to transport toner therefrom to the media. The fuser 12 fuses the toner to the media. The fuser 12 may include a heated drum, and the like. The media transport assembly 13 includes a simplex media path 13*b* and a duplex media path 13*a* to transport the media.

Referring to FIG. 1, the simplex media path 12*b* guides the media to the toner applicator 11 and the fuser 12 to position a respective side of the media towards the toner applicator 11 to receive the toner thereon. The duplex media path 13*a* guides the media to the simplex media path 13*b* in a manner that another side of the media is positioned towards the toner applicator 11 to receive the toner thereon. The control module 14 includes a movement member 14*a* to selectively move the media along the duplex media path 13*a* in a forward duplex direction to direct the media to the simplex media path 13*b*. Alternatively, the movement member 14*a* also selectively moves the media in a reverse duplex direction opposite from the forward duplex direction to direct the media to an output area outside of the media transport assembly 13 in response to a media flushing event. In some examples, the movement member 14*a* may include a first drive motor.

In some examples, the control module 14 may be implemented in hardware, software including firmware, or combinations thereof. For example, the firmware may be stored in memory and executed by a suitable instruction-execution system. If implemented in hardware, as in an alternative example, the control module 14 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In some examples, the control module 14 may be implemented in a combination of software and data executed and stored under the control of a computing device.

Figure 2:
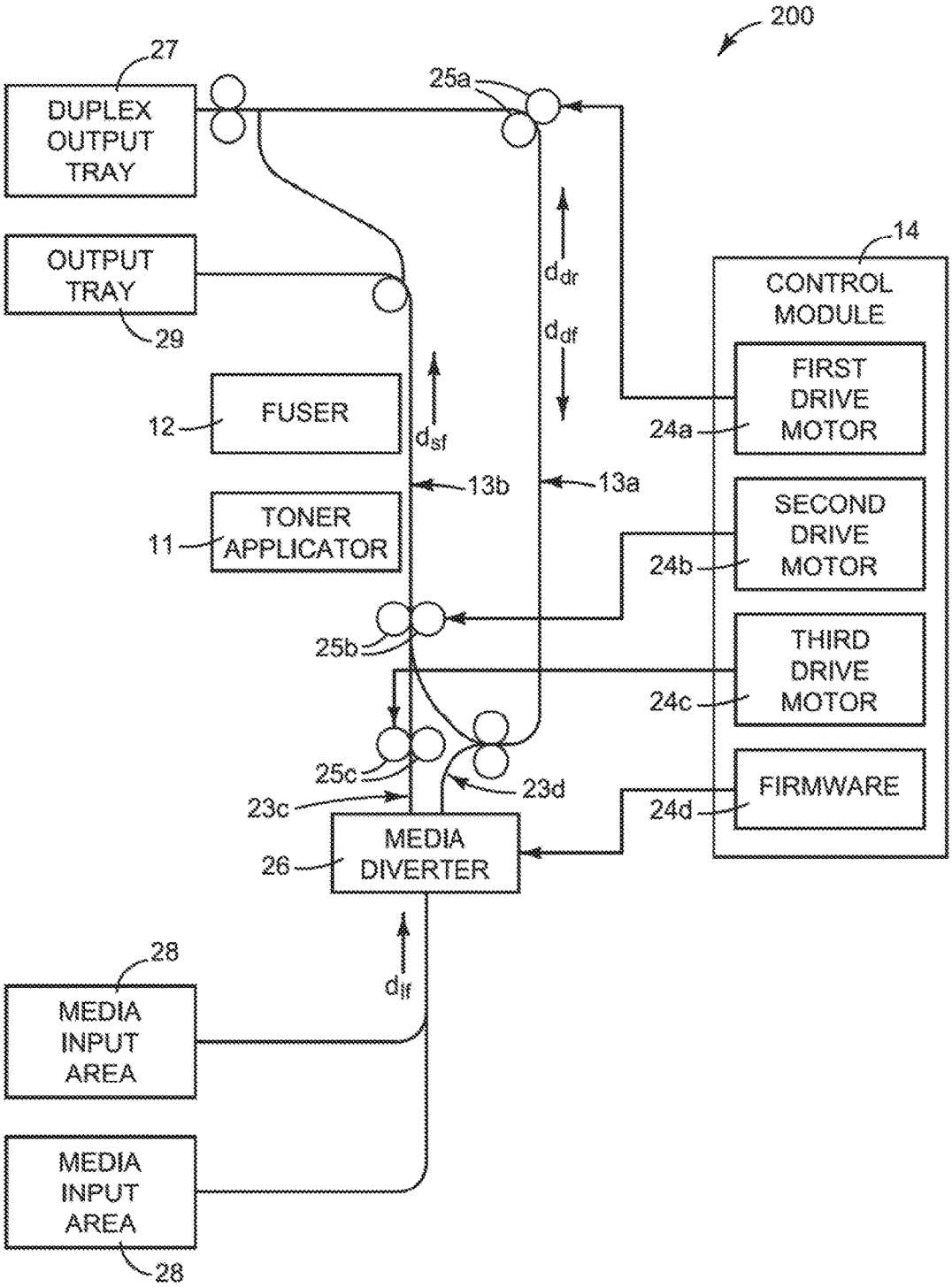
FIG. 2 is a schematic view illustrating a printing apparatus according to an example.

FIG. 2 is a schematic view of a printing apparatus according to an example. Referring to FIG. 2, in some examples, the printing apparatus 200 may include a toner applicator 11, a fuser 12, a media transport assembly 13, and a control module 14. The toner applicator 11 applies toner to media. The fuser 12 fuses the toner to the media. The media transport assembly 13 (13*a*, 13*b*, 23*c*, 23*d*, and 26 collectively 13) includes a simplex media path 13*b*, a duplex media path 13*a*, a media loading path 23*c*, a media diverting path 23*d*, and a media diverter 26, to transport the media.

Referring to FIG. 2, in some examples, the duplex media path 13*a* may include a first set of feed rollers 25*a* and the simplex media path may include a second set of feed rollers 13*b*. That is, the simplex media path 13*b* may include the second set of feed rollers 25*b* to guide the media to the toner applicator 11 and the fuser 12 to position a respective side of the media towards the toner applicator 11 to receive the toner thereon. The media may be transported to an output tray 29 along the simplex media path 13*b* after receiving toner and having the toner fused thereon. For duplex printing, the media may first be transported from the simplex media path 13*b* to the duplex media path 13*a* and, subsequently, transported to the output tray 29. Additionally, the duplex media path 13*a* may include the first set of feed rollers 25*a* to guide the media to the simplex media path 13*b* in a manner that another side of the media is positioned towards the toner applicator 11 to receive the toner thereon. In some examples, the duplex media path 13*a* may be disposed substantially parallel to the simplex media path 13*b* and/or disposed to bypass the toner applicator 11 and the fuser 12.

Referring to FIG. 2, in some examples, the media loading path 23*c* may include a third set of feed rollers 25*c* to guide the media from at least one media input area to the simplex media path. The media diverting path 23*d* may be disposed proximate to an intersection of the simplex media path 13*b* and the duplex media path 13*a*. The media diverter path 23*d* communicates with the media diverter 26 to direct the media to the duplex media path 13*a* based on the control module 14 in response to the media flushing event. The media diverter 26 selectively moves between a simplex position to direct the media to the simplex media path 13*b* and a duplex position to direct the media to the duplex media path 13*a* based on a control module 14 in response to the media flushing event. In some examples, the media diverter 26 may include a movable gate, a movable path, and movable rollers.

Referring to FIG. 2, in some examples, the control module 14 may include a first drive motor 24*a*, a second drive motor 24*b*, a third drive motor 24*c*, and firmware 24*d*. The first drive motor 24*a* may include a forward driving direction and a reverse driving direction. For example, the first drive motor 24*a* moves the media along the duplex media path 13*a* in the forward duplex direction $d_{df}$ when in the forward driving direction. Alternatively, the first drive motor 24*a* moves the media along the duplex media path 13*a* in the reverse duplex direction $d_{dr}$ when in the reverse driving direction in response to the media flushing event. That is, the first drive motor 24*a* selectively moves the media along the duplex media path 13*a* in the forward duplex direction $d_{df}$ to direct the media to the simplex media path 13*b*, and in the reverse duplex direction $d_{dr}$ opposite from the forward duplex direction $d_{df}$ to direct the media to an output area outside of the media transport assembly 13 in response to a media flushing event. In some examples, the output area may include a duplex output tray 27.

Figure 3:
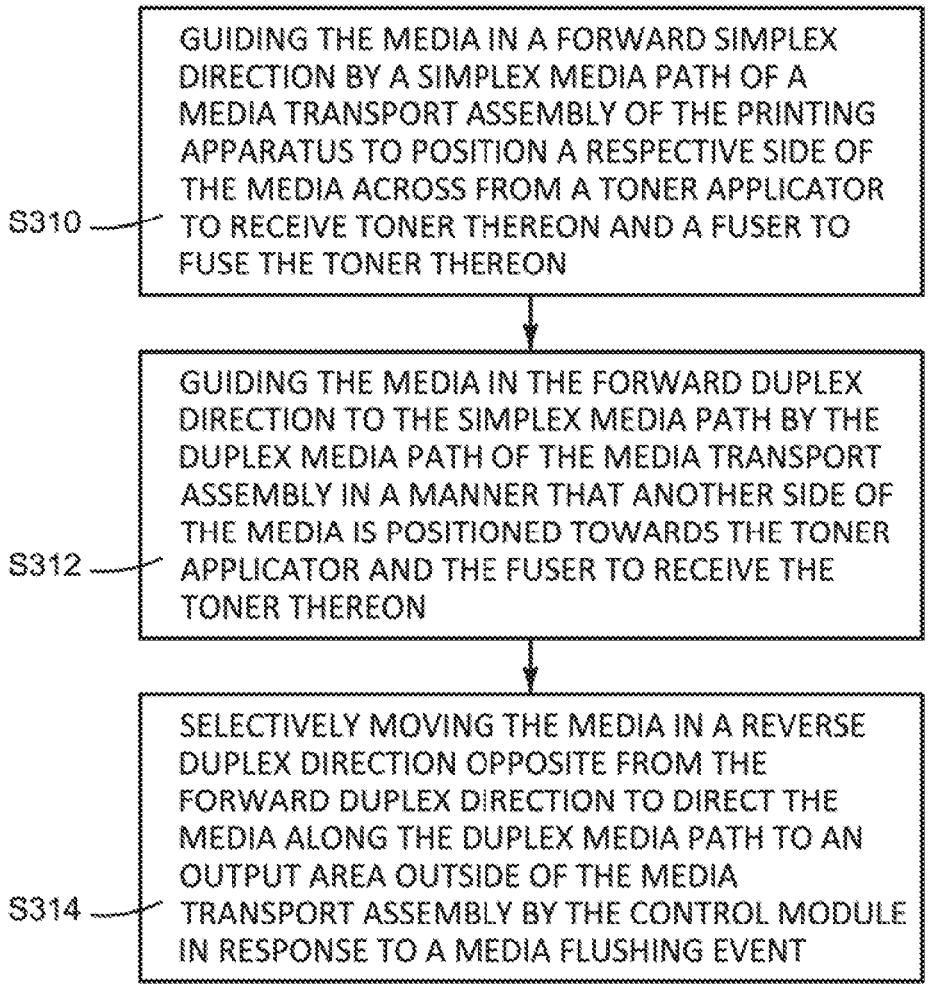
FIG. 3 is a flowchart illustrating a method of transporting media in a printing apparatus according to an example.

Referring to FIG. 2, in some examples, the second drive motor 24*b* may include a forward driving direction to move the media along the simplex media path 13*a* in the forward simplex direction $d_{sf}$. For example, the second drive motor 24*b* may be coupled to the second set of feed rollers 25*b* to transport the media in the forward simplex direction $d_{sf}$. The third drive motor 24*c* may be coupled to the third set of feed rollers 25*c* to guide the media from at least one media input area 28 to the simplex media path 13*b*. The firmware 24*d* may include machine-readable instructions to identify the media flushing event. For example, the media flushing event may be an unintended stoppage of a media lacking unfused toner thereon. The unintended stoppage may be due to firmware errors, losses of power, media jams, doors of the printing apparatus 200 being opened during the printing process, and the like. Further, it is undesirable to flush media with unfused toner that may spread to other components in the media transport assembly 13 and likely cause print quality defects on subsequent media, and the like FIG. 3 is a flowchart illustrating a method of transporting media in a printing apparatus according to an example. Referring to FIG. 3, in block S310, the media is guided in a forward simplex direction by a simplex media path of a media transport assembly of the printing apparatus to position a respective side of the media across from a toner applicator to receive toner thereon and a fuser to fuse the toner thereon. In block S312, the media is guided in the forward duplex direction to the simplex media path by the duplex media path of the media transport assembly in a manner that another side of the media is positioned towards the toner applicator and the fuser to receive the toner thereon. In block S314, the media is selectively moved in a reverse duplex direction opposite from the forward duplex direction to direct the media along the duplex media path to an output area outside of the media transport assembly by the control module in response to a media flushing event. In some examples, the method may also include guiding the media by a media loading path of the media transport assembly from at least one media input area such as a media input tray to the simplex media path. Additionally, the method may also include directing the media to the duplex media path by a media diverter based on a control module in response to the media flushing event.

Figure 4:
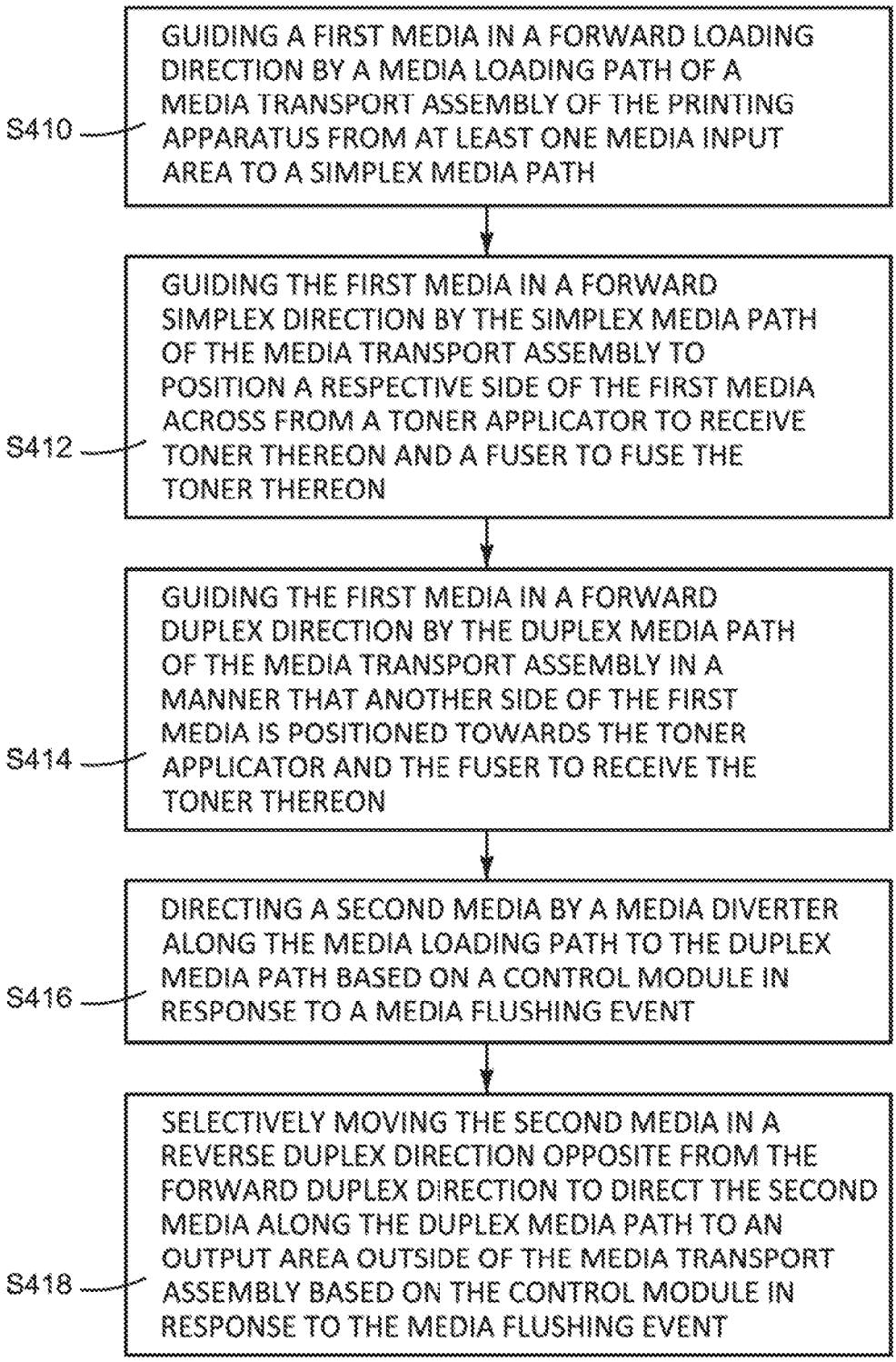
FIG. 4 is a flowchart illustrating a method of flushing media in a printing apparatus according to an example.

FIG. 4 is a flowchart illustrating a method of flushing media in a printing apparatus according to an example. Referring to FIG. 4, in block S410, a first media is guided in a forward loading direction by a media loading path of a media transport assembly of the printing apparatus from at least one media input area to a simplex media path. In block S412, the first media is guided in a forward simplex direction by the simplex media path of the media transport assembly to position a respective side of the first media across from a toner applicator to receive toner thereon and a fuser to fuse the toner thereon. In block S414, the first media is guided in a forward duplex direction by the duplex media path of the media transport assembly in a manner that another side of the first media is positioned towards the toner applicator and the fuser to receive the toner thereon. In block S416, a second media is directed by a media diverter along the media loading path to the duplex media path based on a control module in response to a media flushing event. In block S418, the second media is selectively moved in a reverse duplex direction opposite from the forward duplex direction to direct the second media along the duplex media path to an output area outside of the media transport assembly based on a control module in response to the media flushing event.

Figure 5:
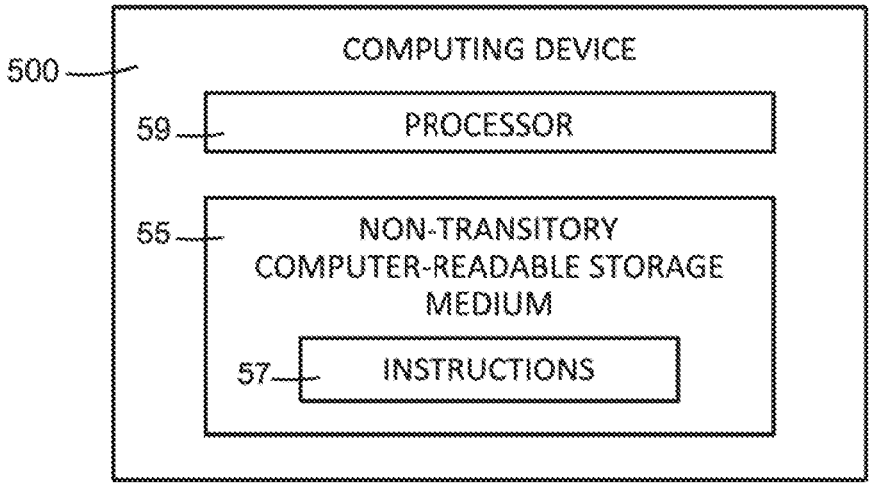
FIG. 5 is a block diagram illustrating a computing device including a processor and a non-transitory, computer-readable storage medium to store instructions to flush media in a printing apparatus according to an example.

FIG. 5 is a block diagram illustrating a computing device including a processor and a non-transitory, computer-readable storage medium to store instructions to flush media in a printing apparatus according to an example. Referring to FIG. 5, in some examples, the non-transitory, computer-readable storage medium 55 may be included in a computing device 500 such as a printing apparatus to flush media therein. In some examples, the non-transitory, computer-readable storage medium 55 may be implemented in whole or in part as instructions 57 such as computer-implemented instructions stored in the computing device locally or remotely, for example, in a server or a host computing device.

Referring to FIG. 5, in some examples, the non-transitory, computer-readable storage medium 55 may correspond to a storage device that stores instructions 57, such as computer-implemented instructions and/or programming code, and the like. For example, the non-transitory, computer-readable storage medium 55 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 5, examples of storage devices include, but are not limited to, hard disk drives, compact disc drives, digital versatile disc drives, optical drives, and flash memory devices. In some examples, the non-transitory, computer-readable storage medium 55 may even be paper or another suitable medium upon which the instructions 57 are printed, as the instructions 57 can be electronically captured, via, for instance, optical scanning of the paper or other medium, then compiled, interpreted or otherwise processed in a single manner, if necessary, and then stored therein. A processor 59 generally retrieves and executes the instructions 57 stored in the non-transitory, computer-readable storage medium 55, for example, to operate a computing device 500 such a printing apparatus to flush media therein in accordance with an example. In an example, the non-transitory, computer-readable storage medium 55 can be accessed by the processor 59.

It is to be understood that the flowcharts of FIGS. 3 and 4 illustrate architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 3 and 4 illustrate a specific order of execution, the order of execution may differ from that which is depicted. For example, the order of execution of two or more blocks may be rearranged relative to the order illustrated. Also, two or more blocks illustrated in succession in FIGS. 3 and 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printing apparatus, comprising:

a toner applicator to apply toner to media;

a fuser to fuse the toner to the media; and a media transport assembly to transport the media, the media transport assembly including a simplex media path and a duplex media path;

the simplex media path to guide the media to the toner applicator to position a respective side of the media towards the toner applicator to receive the toner thereon and the fuser; and the duplex media path to guide the media to the simplex media path in a manner that another side of the media is positioned towards the toner applicator to receive the toner thereon; and a control module including a movement member to selectively move the media along the duplex media path in a forward duplex direction to direct the media to the simplex media path, and a reverse duplex direction opposite from the forward duplex direction to direct the media to bypass the simplex media path to an output area outside of the media transport assembly in response to a media flushing event, wherein, in response to the media flushing event, the control module is to move media path in the reverse duplex direction from both the simplex media path and a media input area.

2. The printing apparatus of claim 1, wherein the movement member comprises:

a first drive motor having a forward driving direction and a reverse driving direction;

the first drive motor to move the media along the duplex media path in the forward duplex direction when in the forward driving direction; and the first drive motor to move the media along the duplex media path in the reverse duplex direction when in the reverse driving direction in response to the media flushing event.

3. The printing apparatus of claim 2, wherein the duplex media path comprises:

a first set of feed rollers coupled to the first drive motor to transport the media in the forward duplex direction and the reverse duplex direction.

4. The printing apparatus of claim 1, wherein the control module further comprises:

a second drive motor having a forward driving direction to move the media along the simplex media path in a forward simplex direction.

5. The printing apparatus of claim 4, wherein the simplex media path comprises a second set of feed rollers coupled to the second drive motor to transport the media in the forward simplex direction and the media transport assembly further includes a media loading path including a third set of feed rollers coupled to a third drive motor to guide the media from at least one media input area to the simplex media path.

6. The printing apparatus of claim 1 wherein the media flushing event is an unintended stoppage of a media lacking unfused toner thereon.

7. The printing apparatus of claim 1, wherein the media transport assembly further comprises:

a media diverter to selectively move between a simplex position to direct the media to the simplex media path and a duplex position to direct the media to the duplex media path based on the control module in response to the media flushing event.

8. The printing apparatus of claim 7, wherein the media transport assembly further comprises:

a media diverting path disposed proximate to an intersection of the simplex media path and the duplex media path, the media diverter path to communicate with the media diverter to direct the media to the duplex media path based on the control module in response to the media flushing event.

9. The printing apparatus of claim 1, wherein the duplex media path is disposed substantially parallel to the simplex media path.

10. The printing apparatus of claim 1, wherein the duplex media path is disposed to bypass the toner applicator and the fuser.

11. The printing apparatus of claim 1, wherein the output area comprises:

a duplex output tray.

12. The printing apparatus of claim 1, wherein the control module further comprises:

firmware including machine-readable instructions to identify the media flushing event.

13. A method of transporting media in a printing apparatus, the method comprising:

guiding the media from a media input area in a forward simplex direction by a simplex media path of a media transport assembly of the printing apparatus to position a respective side of the media across from a toner applicator to receive toner thereon and a fuser to fuse the toner thereon;

guiding the media in a forward duplex direction to the simplex media path by a duplex media path of the media transport assembly in a manner that another side of the media is positioned towards the toner applicator and the fuser to receive the toner thereon; and in response to a media flushing event, selectively moving the media and additional media from the media input area in a reverse duplex direction opposite from the forward duplex direction to direct the media along the duplex media path, bypassing the simplex media path, to an output area outside of the media transport assembly by a control module in response to a media flushing event.

14. The method of claim 13, further comprising:

guiding the media by a media loading path of the media transport assembly from at least one media input area to the simplex media path; and directing the media to the duplex media path by a media diverter based on the control module in response to the media flushing event.

15. A non-transitory computer-readable storage medium having computer executable instructions stored thereon to flush media in a printing apparatus, the instructions are executable by a processor to:

guide a first media in a forward loading direction by a media loading path of a media transport assembly of the printing apparatus from at least one media input area to a simplex media path;

guide the first media in a forward simplex direction by the simplex media path of the media transport assembly to position a respective side of the first media across from a toner applicator to receive toner thereon and a fuser to fuse the toner thereon;

guide the first media in a forward duplex direction by a duplex media path of the media transport assembly in a manner that another side of the first media is positioned towards the toner applicator and the fuser to receive the toner thereon; and in response to a media flushing event:

selectively move the first media in a reverse duplex direction opposite from the forward duplex direction to direct the first media along the duplex media path to an output area outside of the media transport assembly;

direct a second media by a media diverter along the media loading path to the duplex media path based on a control module; and selectively move the second media in the reverse duplex direction opposite from the forward duplex direction to direct the second media along the duplex media path, bypassing the simplex media path, to the output area.

* * * * *